US008579549B2

(12) United States Patent
Freitag et al.

(10) Patent No.: US 8,579,549 B2
(45) Date of Patent: Nov. 12, 2013

(54) REINFORCED GROUND STRUCTURE, AND SIDING ELEMENTS FOR CONSTRUCTING SAME

(75) Inventors: Nicolas Freitag, Orsay (FR); Jean-Claude Morizot, Paris (FR)

(73) Assignee: Terre Armee Internationale, Velizy Villacoublay (FR)

( * ) Notice: Subject to any disclaimer, the term of this patent is extended or adjusted under 35 U.S.C. 154(b) by 97 days.

(21) Appl. No.: 13/132,314

(22) PCT Filed: Dec. 1, 2009

(86) PCT No.: PCT/FR2009/052353

§ 371 (c)(1),
(2), (4) Date: Jun. 1, 2011

(87) PCT Pub. No.: WO2010/063939

PCT Pub. Date: Jun. 10, 2010

(65) Prior Publication Data

US 2011/0236141 A1 Sep. 29, 2011

(30) Foreign Application Priority Data

Dec. 2, 2008 (FR) ..... 08 58196

(51) Int. Cl.
*E02D 29/02* (2006.01)

(52) U.S. Cl.
USPC ..... 405/262; 405/284; 405/302.4

(58) Field of Classification Search
USPC ..... 405/262, 284, 285, 286, 302.4, 302.6, 405/302.8
See application file for complete search history.

(56) References Cited

U.S. PATENT DOCUMENTS

| | | | | |
|---|---|---|---|---|
| 4,273,476 | A * | 6/1981 | Kotulla et al. | 405/284 |
| 4,343,571 | A * | 8/1982 | Price | 405/284 |
| 5,839,855 | A * | 11/1998 | Anderson et al. | 405/262 |
| 6,416,260 | B1 | 7/2002 | Khamis | |
| 6,468,004 | B1 * | 10/2002 | Price | 405/262 |
| 7,491,018 | B2 * | 2/2009 | Freitag et al. | 405/262 |
| 7,850,400 | B2 * | 12/2010 | Freitag et al. | 405/262 |
| 8,011,859 | B2 * | 9/2011 | Freitag et al. | 405/262 |

(Continued)

FOREIGN PATENT DOCUMENTS

| | | |
|---|---|---|
| EP | 0130949 | 1/1985 |
| EP | 1662050 | 5/2006 |

(Continued)

*Primary Examiner* — Frederick L Lagman
(74) *Attorney, Agent, or Firm* — McKenna Long & Aldridge LLP

(57) ABSTRACT

The invention relates to a structure including a fill (1), reinforcing strips (2), and facing (3), the reinforcement strips (2) being anchored to the facing (3). The facing incorporates a path formed for a reinforcement strip (2) between two emergence points (PE1, PE2) that are located at the back surface (7) of the facing, wherein the path comprises: two adjacent portions (21, 22) that are placed so as to position each strip within an emergence plane (P1, P2); two curved portions (23, 24) provided as extensions of the two adjacent portions (21, 22) and arranged so as to deviate the strip out from the emergence planes (P1, P2); and a connecting portion connecting together the two curved portions (23, 24). In the structure, both emergence planes (P1, P2) are distinct and separated by a physical separator, and the connecting portion includes at least one loop (25) located outside the emergence planes (P1, P2) and outside the space between said emergence planes. The invention also relates to a related facing element.

17 Claims, 7 Drawing Sheets

(56) References Cited

U.S. PATENT DOCUMENTS

| | | | | |
|---|---|---|---|---|
| 2001/0014255 | A1* | 8/2001 | Orsat | 405/15 |
| 2006/0110221 | A1* | 5/2006 | Freitag et al. | 405/262 |
| 2006/0171783 | A1* | 8/2006 | Freitag et al. | 405/262 |

FOREIGN PATENT DOCUMENTS

| | | |
|---|---|---|
| FR | 2868447 | 10/2005 |
| WO | WO 98/06907 | 2/1998 |
| WO | WO 2007/012864 | 2/2007 |

* cited by examiner

FIG.8.
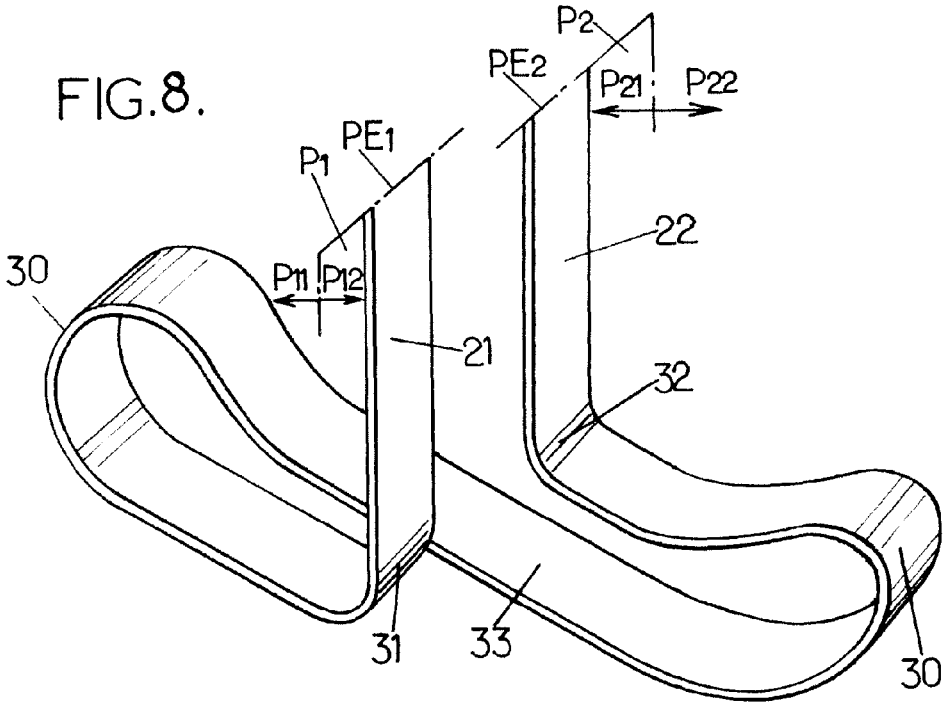
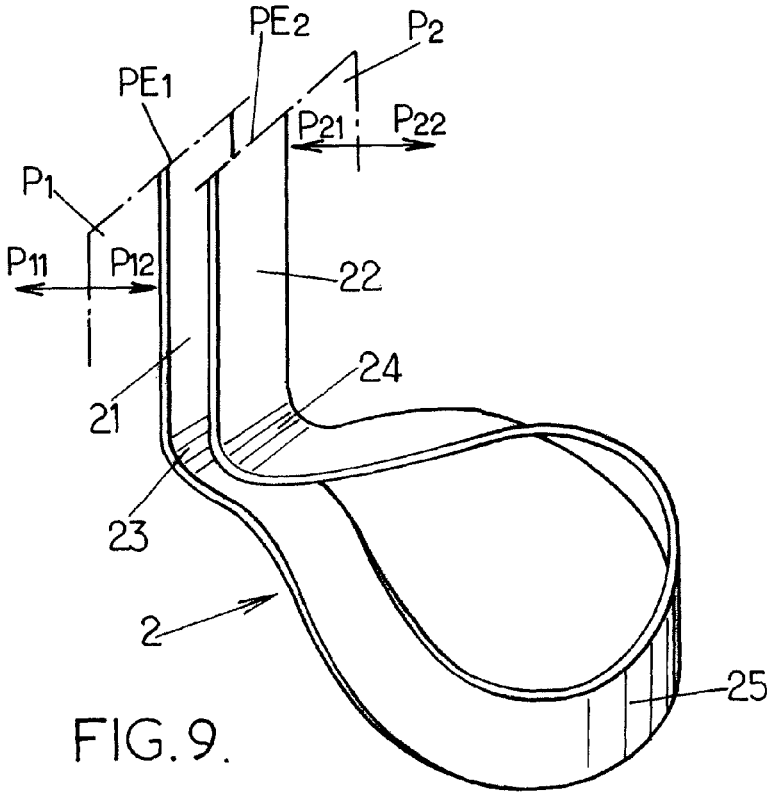
FIG.9.

REINFORCED GROUND STRUCTURE, AND SIDING ELEMENTS FOR CONSTRUCTING SAME

This application is a National Stage Entry of International Application No. PCT/FR2009/052353 filed on Dec. 1, 2009, and claims the benefit of and France Patent Application No. 08 58196 filed on Dec. 2, 2008, both of which are hereby incorporated by reference for all purposes in their entirety.

The present invention relates to the construction of stabilized soil, or reinforced earth, structures. This construction technique is normally used for producing structures such as retaining walls, bridge abutments, etc.

A stabilized soil structure combines a compacted fill, a facing and reinforcements usually connected to the facing. The reinforcements are put in place in the soil with a density depending on the stresses that may be exerted on the structure, the thrust forces of the terrain being absorbed by the soil-reinforcement friction.

The invention concerns more particularly the case where the reinforcements are in the form of a strip of synthetic material, for example based on polyester fibres.

The facing is most often produced from prefabricated concrete elements, in the form of slabs or blocks, juxtaposed so as to cover the front face of the structure. There may be horizontal steps on this front face between different levels of the facing, when the structure comprises one or more terraces.

The reinforcements placed in the fill are usually secured to the facing by means of mechanical connection members that may take various forms. Once the structure is finished, the reinforcements distributed in the fill transmit high loads, which may range up to several tons. The connection thereof to the facing must be robust in order to preserve the cohesion of the whole.

In some systems, the facing elements are configured so as to have at least one passage intended to receive a reinforcement strip.

The document EP 1 662 050 discloses a reinforced soil structure comprising a fill, reinforcement strips extending in a reinforced area of the fill situated to the rear of a front face of the structure, and a facing placed along said front face, the reinforcement strips being anchored to the facing in respective anchoring regions. In at least one anchoring region, the facing incorporates a path formed for a reinforcement strip between two emergence points situated on a rear face of the facing adjacent to the fill. This path comprises two rectilinear portions respectively adjacent to the two emergence points and each disposed so as to position the strip in the same emergence plane perpendicular to said rear face, two curved portions provided as respective extensions of the two rectilinear portions and disposed so as to deviate the strip out of the emergence plane, and a connecting portion connecting together the two curved portions and having at least one loop situated outside the emergence plane. It also describes a facing element adapted to such a structure.

This solution, although highly advantageous, may nevertheless have a drawback during the construction of such a structure.

This is because such a structure is generally constructed by disposing at least one facing fitted along a front face of the structure delimiting a volume to be filled and by performing the following successive steps:

filling material is brought and compacted substantially horizontally in said volume as far as the emergence plane of the facing element so as to create a laying surface;

a trench is dug in an area of the laying surface, corresponding for example to an area where provision is made for disposing the end of the reinforcement strip;

a reinforcement strip is disposed that follows said path in the facing element so that the two portions of strips that emerge therefrom rest on the strip surface and in at least part of the trench;

the strip is tensioned by adding filling material on the strip so as at least to fill the trench.

The excavation step for digging a trench extends the duration of the work and requires the use of labour.

The object of the present invention is to propose a new method of anchoring reinforcement strips to a facing of a stabilized soil structure that reduces the effect of the above problems.

The invention proposes a stabilized soil structure comprising a fill, reinforcement strips extending in a reinforced area of the fill situated to the rear of a front face of the structure, and a facing placed along said front face, the reinforcement strips being anchored to the facing in respective anchoring regions, wherein the facing incorporates, in at least one anchoring region, a path formed for a reinforcement strip between two emergence points situated on a rear face of the facing adjacent to the fill, wherein the path comprises two adjacent portions respectively adjacent to the two emergence points and each disposed so as to position the strip in an emergence plane substantially perpendicular to said rear face, two curved portions provided as respective extensions of the two adjacent portions and disposed so as to deviate the strip out of the emergence planes, and a connecting portion connecting together the two curved portions, characterized in that the two emergence planes are distinct, separated by a physical separator and substantially parallel to each other in order to form top and bottom emergence planes, and in that the connecting portion comprises at least one loop situated outside the emergence planes and outside the space between these emergence planes.

The invention also proposes a stabilized soil structure comprising a fill, reinforcement strips extending in a reinforced area of the fill situated to the rear of a front face of the structure, and a facing placed along said front face, the reinforcement strips being anchored to the facing in respective anchoring regions, wherein the facing incorporates, in at least one anchoring region, a path formed for a reinforcement strip between two emergence points situated on a rear face of the facing adjacent to the fill, wherein the path comprises two adjacent portions respectively adjacent to the two emergence points and each disposed so as to position the strip in a respective emergence plane substantially perpendicular to said rear face, two curved portions provided as respective extensions of the two adjacent portions and disposed so as to deviate the strip out of the emergence planes, and a connecting portion connecting together the two curved portions, wherein the two emergence planes are distinct and substantially parallel to each other in order to form top and bottom emergence planes, and wherein the connection portion comprises at least one loop situated outside the emergence planes and outside the space between these emergence planes.

Allowing emergence in the reinforced area of the fill of portions of reinforcement strip in two distinct emergence planes while connecting these two strip portions by a path in the facing comprising at least one loop situated outside the emergence planes and outside the space between these emergence planes makes it possible both to stress the facing, consisting in general of cast material, such as concrete, in a satisfactory manner, and to simply put the portions of the strip under tension. Because of the offset between the emergence planes, it is possible to tension the portions of the strip after they have been disposed on a laying surface, situated at the bottom emergence plane, by simple addition of filling material.

The fill thus pushes the portion of the strip emerging from the top plane towards the one emerging from the bottom plane, effectively ensuring tensioning of the portions of the strip.

In the context of the invention, "an emergence plane substantially perpendicular" to a face means a plane the angle of which with respect to a plane perpendicular to the tangent plane of the said face in the emergence area is less than or equal to 25°, for example less than or equal 10°, in particular equal to 0°.

In the context of the invention, "two distinct emergence planes substantially parallel to each other" means two planes defined above, which may form between them an angle of less than or equal to 30° for example less than or equal to 15°, and are thus able to intersect each other at a distance from the anchoring means. The angle between these two emergence planes may be an angle measured with respect to the plane perpendicular to the tangent plane of the base of the facing in the emergence zone in a direction perpendicular and/or parallel to said tangent plane.

In the context of the invention, "physical separator" means a part of the material disposed in the anchoring region and adapted to separate the two emergence planes. The physical separator may be in continuity of material in the anchoring region of the facing. It may also consist of a piece attached in the anchoring region of the facing.

In one embodiment of the structure, the adjacent portions are rectilinear portions.

According to an embodiment, the two substantially parallel emergence planes are separated in the anchoring region by a distance greater than or equal to 2 cm and less than or equal to 20 cm, for example greater than or equal to 5 cm and/or less than or equal 15 cm.

According to an embodiment, the adjacent portions emerge at the rear face of the facing in the form of slots, comprising the emergence point, and two slots connected by the same path are offset so as not to cross a common vertical plane.

According to another embodiment, the adjacent portions emerge at the rear face of the facing in the form of slots, comprising the emergence points, and where two slots connected by the same path cross a common vertical plane.

Preferably, the adjacent portions of said path are rectilinear and each extend in the emergence plane over at least half of the thickness of the facing. The reinforcement strip typically has a width of no more than half the thickness of the facing.

In an embodiment of the structure, the facing has, in the anchoring region, a protective sheath receiving the reinforcement strip along said path. This sheath isolates the strip from the moulded material in order to protect the reinforcement against premature damage. In particular, if the reinforcement is procured by polyester fibres, it is known that these do not well accept basic environments such as those that are encountered in concrete. The aforementioned sheath therefore supplements the protection conferred by the plastic sheath that coats the polyester fibres of the strip.

Another aspect of the invention relates to a facing element for a stabilized soil structure comprising a body made from cast material inside which a path is formed for a reinforcement strip between two emergence points situated on a rear face of the body, wherein the path comprises two adjacent portions respectively adjacent to the two emergence points and each disposed so as to position the strip in a respective emergence plane perpendicular to said rear face, two curved portions provided as respective extensions of the two adjacent portions and disposed so as to deviate the strip out of the emergence planes, and a connecting portion connecting together the two curved portions, wherein the two emergence planes are distinct, separated by a physical separator and substantially parallel to each other, and wherein the connecting portion comprises at least one loop situated outside the emergence planes and outside the space between these emergence planes.

The invention also relates to a facing element for a stabilized soil structure comprising a body made from cast material inside which a path is formed for a reinforcement strip between two emergence points situated on a rear face of the body, wherein the path comprises two adjacent portions respectively adjacent to the two emergence points and each disposed so as to position the strip in a respective emergence plane perpendicular to said rear face, two curved portions provided as respective extensions of the two adjacent portions and disposed so as to deviate the strip out of the emergence planes, and a connecting portion connecting together the two curved portions, wherein the two emergence planes are distinct and substantially parallel to each other, and wherein the connecting portion comprises at least one loop situated outside the emergence planes and outside the space between these emergence planes.

The features described above in relation to the stabilized soil structure according to the invention are also directly usable for the purpose of different embodiments of a facing element according to the invention.

According to an embodiment, the adjacent portions emerge at the rear face of the facing in the form of slots, comprising the emergence point, and two slots connected by the same path are offset so as not to cross a common vertical plane when said facing element is disposed in a position similar to the one that it would occupy in an erected structure.

According to another embodiment the adjacent portions emerge at the rear face of the facing in the form of slots, comprising the emergence points, and two slots connected by the same path cross a common vertical plane when said facing element is disposed in a position similar to the one that it would occupy in an erected structure.

Similar position means a position where the facing element will have the same inclinations with respect to the vertical and horizontal planes as if it were disposed in the erected structure, in particular assembled with other facing elements.

The strip may be put in place on the path as soon as the material of the body is cast, with or without the aforementioned protective sheath.

Several arrangements are possible for the path defined for the strip within the facing element. In some embodiments, the two curved portions of the path direct the strip towards the same side of the emergence planes. It is considered that the curved portions of the path direct the strip towards the top side, or respectively the bottom side, if these portions are each oriented above or respectively below each of the emergence planes. In this case, a first possibility is that the path is formed so that the strip is received in the two adjacent portions with the same face of the strip oriented towards this side of the emergence planes. The path is then formed so that said face of the strip is placed either on the external side or on the internal side of the loop situated outside the emergence planes. A second possibility is that the path is formed so that the strip is received in one of the two adjacent portions with a face of the strip oriented towards said side of the emergence planes and in the other one of the two rectilinear portions with said face of the strip oriented opposite to said side of the emergence planes.

In another embodiment, the two curved portions of the path respectively direct the strip towards two opposite sides, one above and the other below the emergence planes, and the connecting portion of the path has two loops respectively extending the two curved portions of the path and a part passing through the emergence planes and connecting together the two loops.

The present invention also relates to a method of constructing a stabilized soil structure according to the invention, wherein at least one facing element according to the invention is disposed on a front face of the structure delimiting a volume to be filled, comprising the following successive steps:

bringing and compacting filling material substantially horizontally in said volume up to the bottom emergence plane of said facing element so as to create a laying surface;

arranging a reinforcement strip that follows said path in the facing element so that two reinforcement strip portions emerge from the rear face of the facing element and rest on the laying surface;

tensioning the band by adding filling material on the strip.

Other features and advantages of the present invention will emerge in the following description of non-limitative example embodiments, with reference to the accompanying drawings, in which:

FIG. 1 is a schematic view in lateral section of a stabilized soil structure according to the invention during construction;

FIGS. 2*a* and *b* illustrate the placing of a known reinforcement of the prior art;

FIGS. 5 to 9 are perspective views of paths that can be followed by the reinforcement strips within the facing elements according to the invention.

Figure 1:
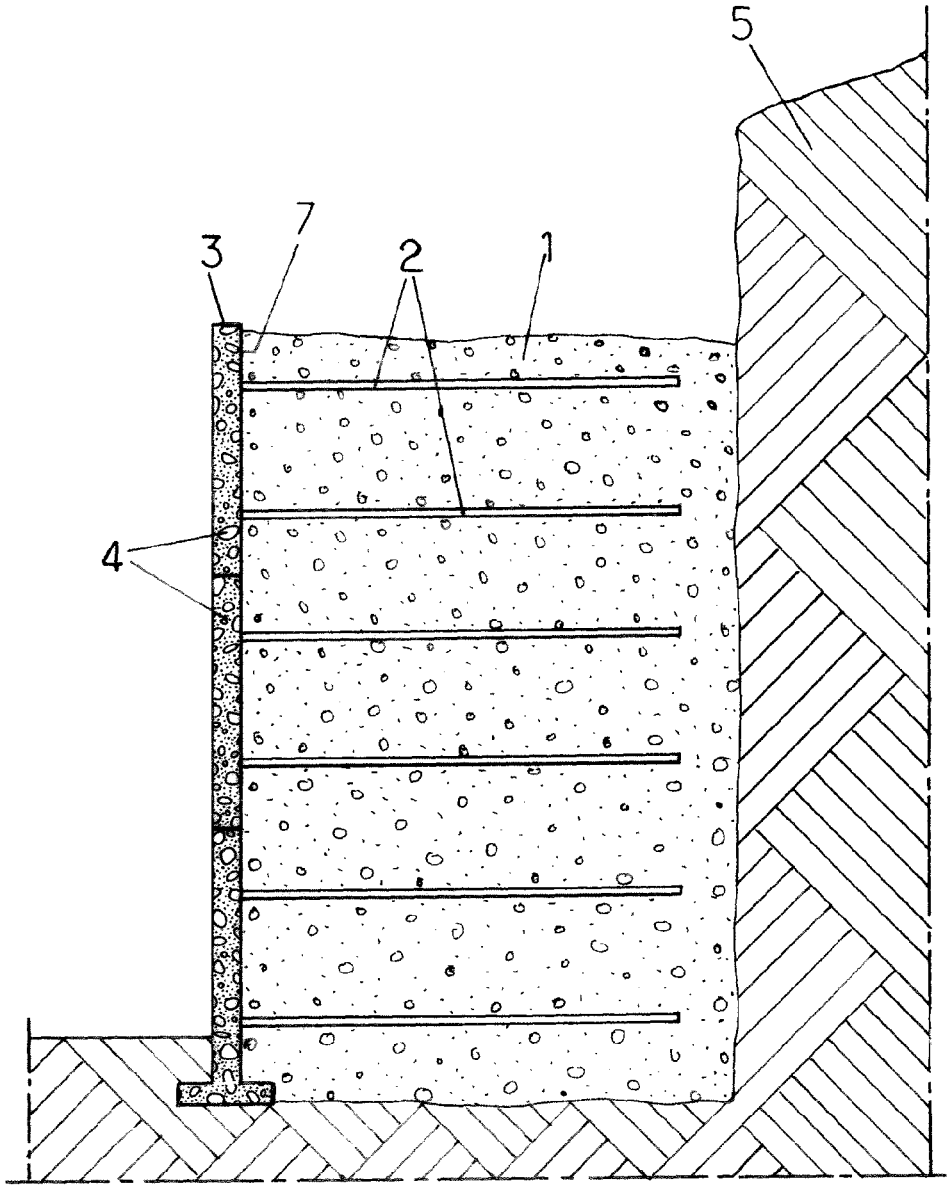

FIG. 1 illustrates the application of the invention to the construction of a stabilized soil retaining wall. A compacted fill 1, in which reinforcements 2 are distributed, is delimited on the front side of the structure by a facing 3 consisting of juxtaposing panel-shaped prefabricated elements 4, and on the rear side by the ground 5 against which the retaining wall is erected.

The reinforcements 2 consist of synthetic reinforcements in the form of flexible strips extending in horizontal planes at the rear of the facing 3. These may in particular be reinforcement strips based on polyester fibres sheathed with polyethylene.

The reinforcement strips 2 are attached to the prefabricated elements 4 assembled so as to form the facing 3. These elements 4 are typically made from reinforced concrete. In the example shown, they are in the form of panels, they could also have other forms, such as blocks. When the concrete of such an element 4 is cast, one or more reinforcement strips 2 are installed in the mould according to a path described below in order to produce the strip/element anchoring. After the concrete has set, each strip has two portions that emerge from the element in order to be installed in the filled block.

In order to erect the structure, it is possible to proceed as follows:

a) position some of the facing elements 4 in order to be in a position then to add filling material over a certain height. In a known manner, the mounting and positioning of the facing elements can be facilitated by assembly members placed between them. The strips 2 are positioned on the facing elements 4 so that some of them are placed at the same horizontal level during mounting of the facing;

b) add filling material and compact it progressively until the next level provided for the positioning of the reinforcement strips 2 is reached;

c) spread the reinforcement strips 2 over the fill at this level;

d) add filling material over the reinforcement strips 2 that have just been installed. This filling material is compacted as it is added;

e) repeat steps b) to d) if several levels of strips are provided per row of facing elements 4;

f) repeat steps a) to e) until the top level of the fill is reached.

Figure 2A:
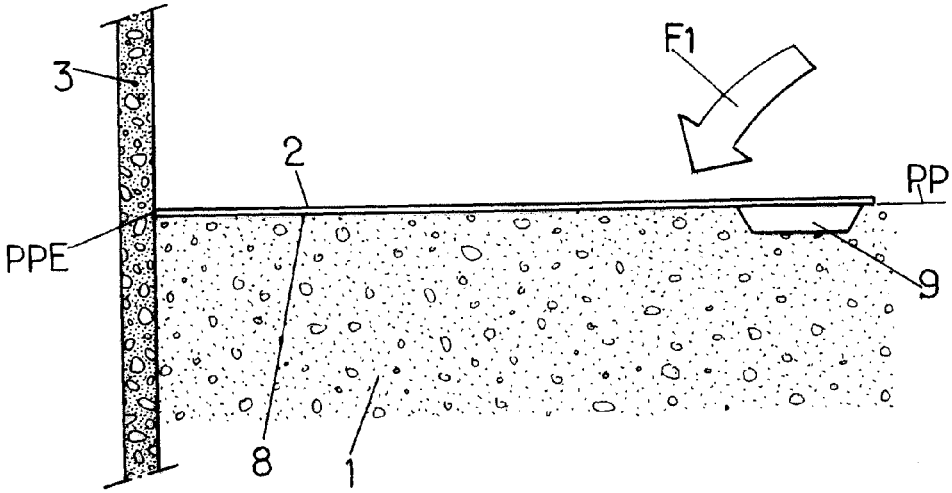
Figure 2B:
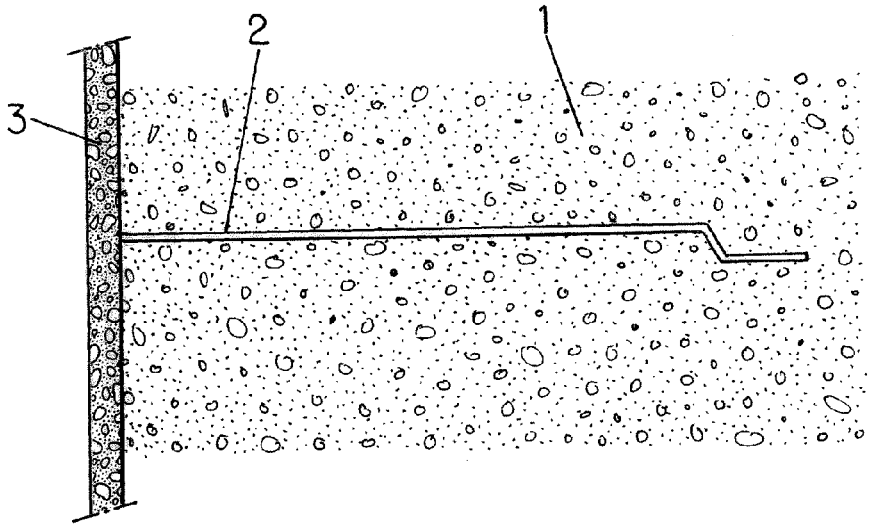

According to a traditional embodiment illustrated in FIGS. 2*a* and *b*, and using a facing element described in EP 1 662 050, the reinforcement strip portions 2 are disposed emerging at points PPE in the same plane, PP, on a compacted fill surface 8 where a trench 9 has been dug as illustrated in FIG. 2*a*. Filling is then disposed in the direction of the arrow F1 and the reinforcement strip portions are tensioned when they match the shape of the trench under the effect of the filling with filling material, as shown in FIG. 2*b*.

Figure 3:
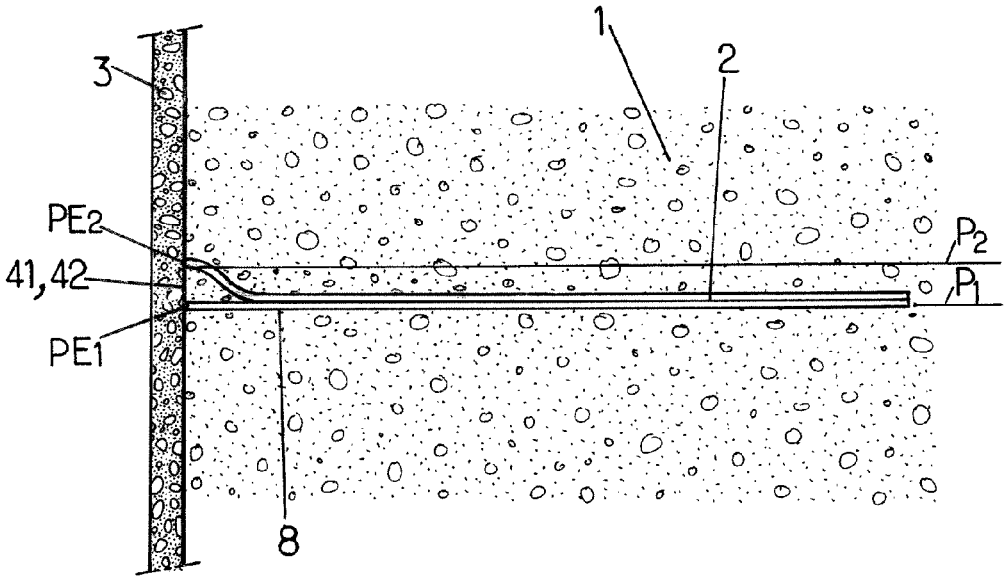
FIG. 3 illustrates the placing of a reinforcement according to the invention.

In the method according to the invention, as illustrated in FIG. 3, the offset between the emergence planes on the same path enable the reinforcement strip portion emerging from the top emergence plane P2 to approach the bottom emergence plane P1 on the same path when reinforcement is added to the strip portions emerging from the emergence points respectively top PE2 and bottom PE1, previously disposed on a laying surface 8 situated in the bottom emergence plane P1. The offset between the emergence planes is obtained by the presence of a physical separator 41, 42 between the two emergence planes. This physical separator 41, 42 is in continuity of material in the anchoring region of the facing. The result is an effective tensioning that ensures satisfactory reinforcement of the structure. In the example shown, the two strips emerging from the points PE1 and PE2 are contiguous and superimposed after addition of the filling material. According to another embodiment, these two strips can be disposed in the same plane after addition of filling material.

Figure 4:
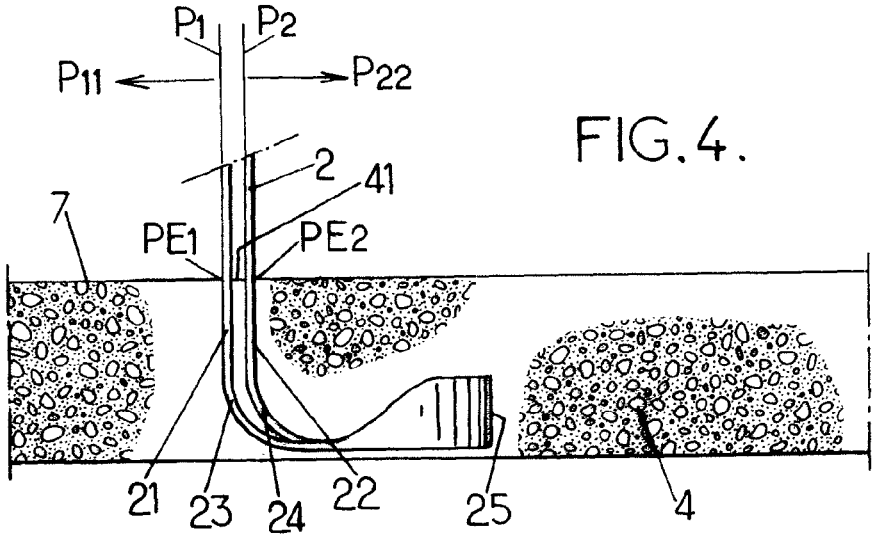
FIG. 4 is a sectional view of a facing element according to the invention.

FIG. 4 shows a facing element 4 that can be used in some embodiments of the invention. As usual, this element 4 is produced from cast concrete. A reinforcement strip 2 is placed in the mould at the time the concrete is poured therein and held until the concrete is set. Guidance thereof can be effected by means of the reinforcement bars of the concrete (not shown), possibly supplemented by deviation rods or members fixed to these bars, so that the strip follows the required path in the anchoring area. This path is defined inside the element 4 between the two emergence points PE1, PE2 of the two portions of the strip on the rear face 7 of the element (the face adjacent to the fill). The physical separator 41, in continuity of material, provides the offset between the two emergence planes.

Figure 5:
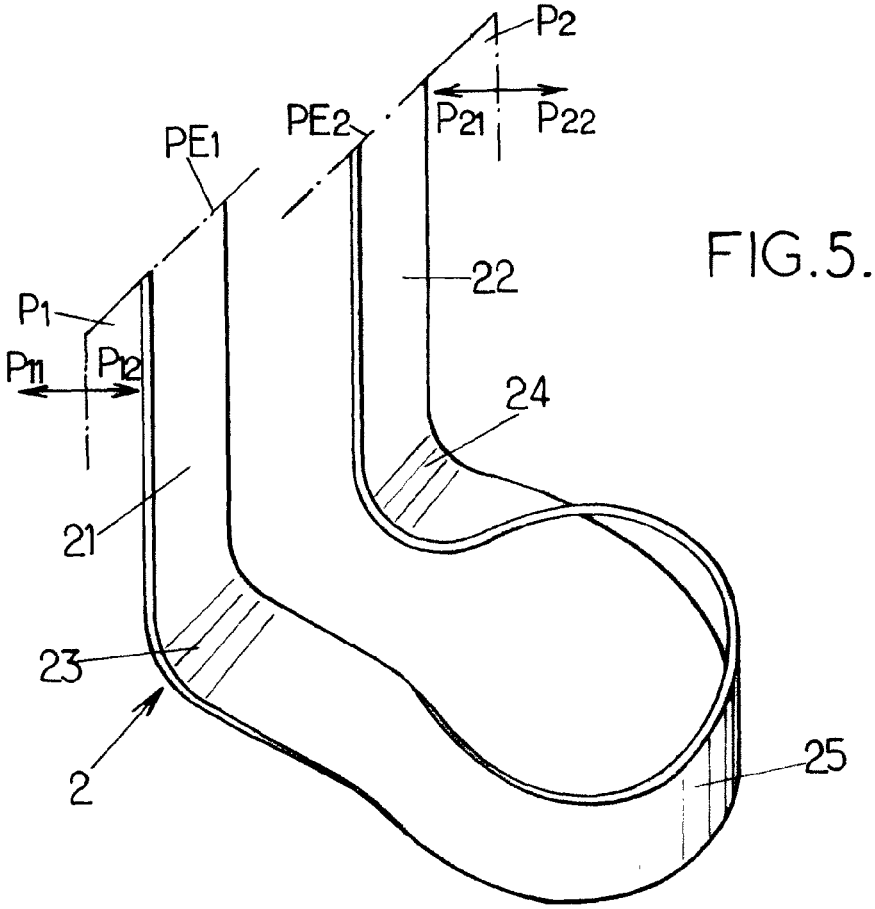

The path corresponding to the element in FIG. 4 is illustrated by FIG. 5.

There are two adjacent portions, here rectilinear 21 and 22, extending perpendicular to the rear face 7 of the element from the emergence points PE1 and PE2. In each adjacent portion 21, 22, the strip remains in each of the distinct emergence planes P1, P2. The rectilinear portions 21, 22 extend over at least half of the thickness of the body of the element 4, measured perpendicular to the rear face 7 thereof. This avoids bad stressing of the concrete in the vicinity of the rear face 7.

Each rectilinear portion 21, 22 of the path of the strip is extended by a respective curved portion 23, 24 where the strip is deviated out of each of the emergence planes P1, P2. Beyond the curved portions 23, 24, the strip 2 extends along the front face of the element, a little recessed with respect to this front face so as not to be visible on the surface of the structure. According to another embodiment the adjacent portions may not be rectilinear but for example slightly curved and make it possible to join the emergence points to curved portions 23, 24 as shown.

The two curved portions 23, 24 are connected together by a connecting point that has a loop 25 situated outside the emergence planes P1, P2.

In the example in FIGS. 4 and 5, the strip is directed towards the same side P12, P22 of the emergence planes P1, P2 in the two curved portions 23, 24 of its path within the facing element 4. This path is formed so that (i) in the two rectilinear portions 21, 22 the strip, has the same face oriented towards the sides P12, P22 of the emergence planes, and (ii) this face of the strip is placed on the external side of the loop 25. Consequently, in the middle of the loop 25, the strip is placed practically perpendicular to the rear face 7 of the element.

Figure 6:
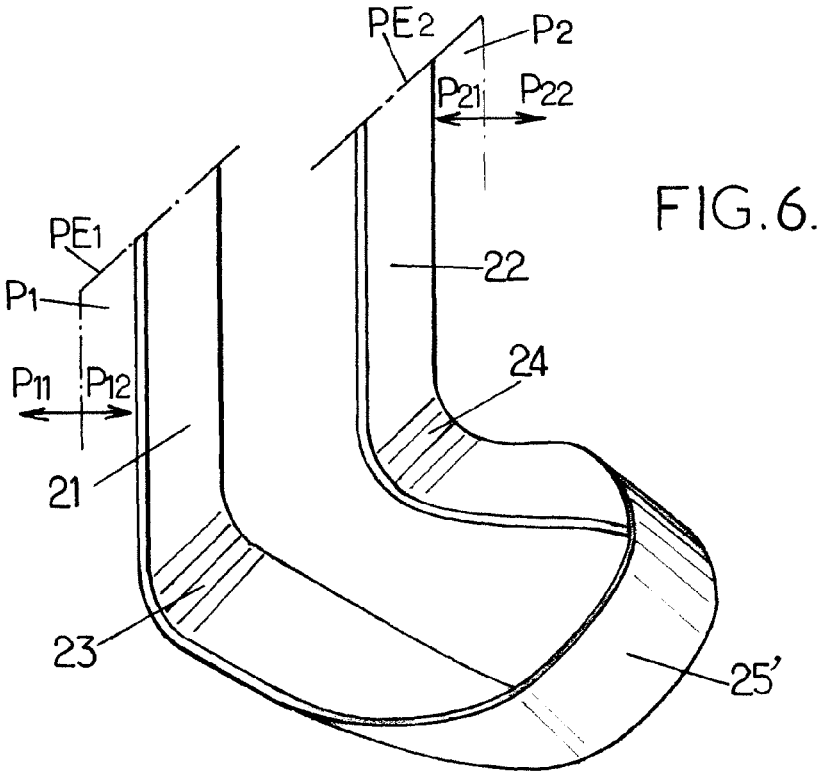

In the variant illustrated by FIG. 6, the loop 25' is oriented in the opposite direction, that is to say the face of the strip oriented towards the sides P12, P22 of the emergence plane is placed on the internal side of the loop 25'.

Figure 7:
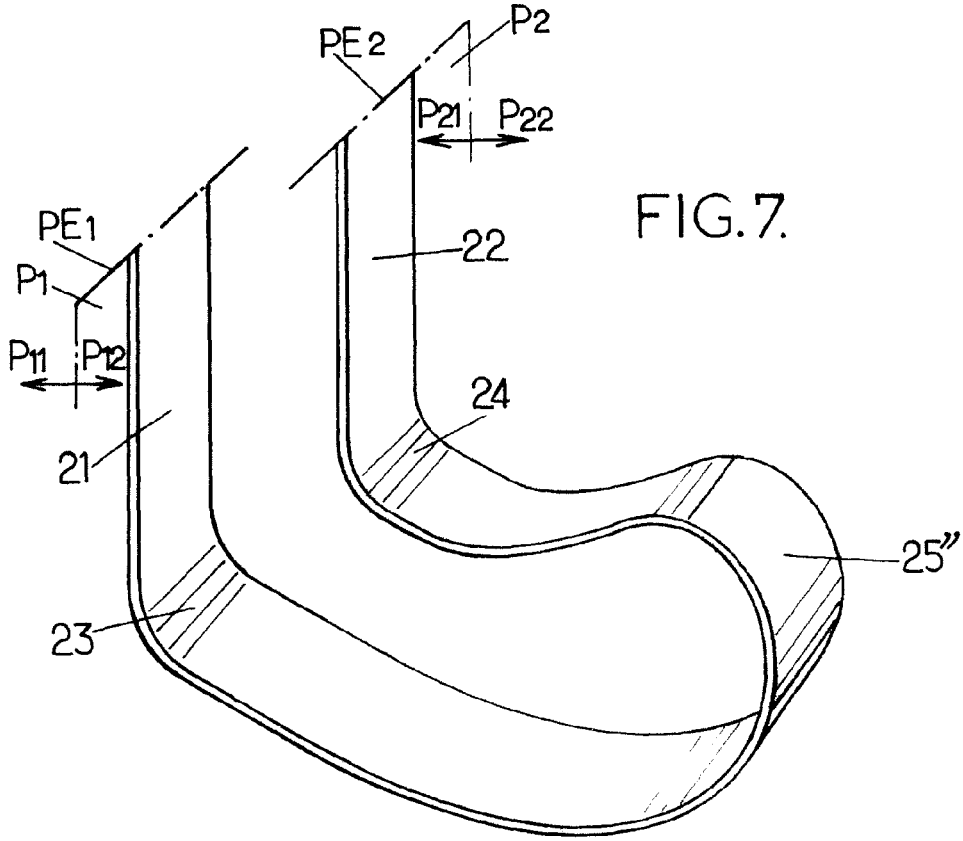

In the variant illustrated by FIG. 7, the strip comprises a loop 25" and follows one of the two rectilinear portions 21, 22 of its path with one of its two faces oriented towards the sides P12, P22 of the emergence planes P1, P2 and the other one of the two rectilinear portions 21, 22 with said face oriented towards the sides P11, P21 of the emergence planes opposite to the sides P12, P22.

Other arrangements are also possible for the path of the reinforcement strip within a facing element. FIG. 8 shows an example of this in which the connecting portion connecting together the two curved portions 31, 32 comprises two loops 30 on either side of the planes P1, P2. In this example, the two curved portions 31, 32 of the path direct respectively the strip towards the two opposite sides P11, P21 and P12, P22 of the emergence planes P1, P2. The connecting portion has a part 33 that traverses the planes P1, P2 and connects together the two loops 30.

In the embodiments illustrated in FIGS. 4 to 8, the emergence points PE1, PE2 are offset from each other and, when a strip is installed in a structure, the two slots situated at the rear face of the facing and from which the strip emerges are offset so as not to cross a common vertical plane.

According to another embodiment illustrated in FIG. 9, the emergence points PE1, PE2 are not offset from each other and, when a strip is installed in a structure, the slots situated on the rear face of the facing and from which the strip emerges cross a common vertical plane. This figure illustrates such an embodiment where the path is of the type illustrated in FIG. 5 and where the two rectilinear portions 21 and 22 are situated one behind the other.

In order easily to follow a path such as the one illustrated by FIGS. 5 to 9, it is preferable for the width of the strip 2 to be less than or no more than equal to half the thickness of the facing element 4. This thickness is typically between 14 and 16 cm. It will then be possible to use strips with a width of approximately 45 mm.

When the reinforcement strip has components (for example polyester fibres) sensitive to basic environments, it may advantageous to place a protective sheath made from plastics material between this strip and the concrete facing. This sheath prevents the alkalinity of the concrete propagating as far as the sensitive component. The flexible sheath receives the strip before being put in place with it in the mould. It is thus surrounded by the moulded concrete and receives the reinforcement along its path in order to isolate it from the concrete.

Figure 10:
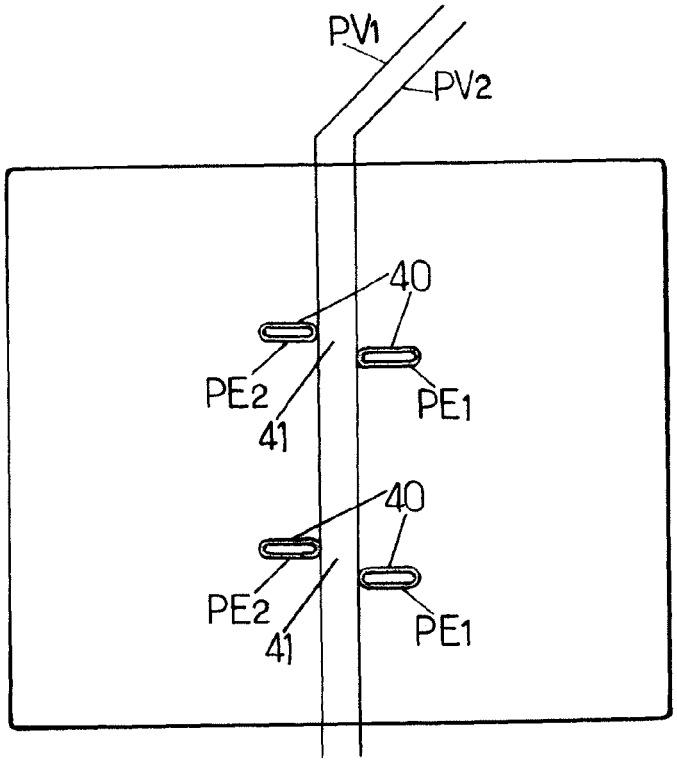
FIGS. 10 and 11 are rear views of facing elements according to the invention.
Figure 11:
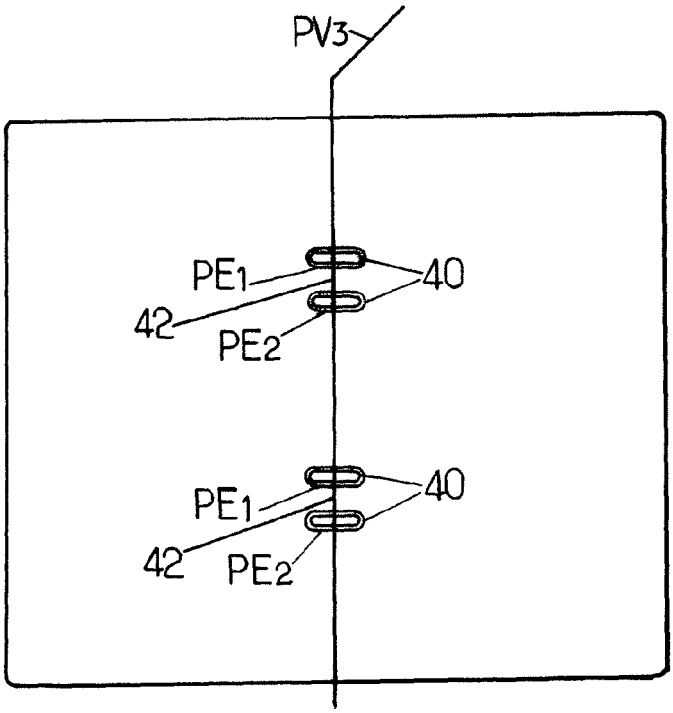

It can be envisaged that the reinforcing strip not yet be installed in its sheath 15 at the time of manufacture of the element. It is then convenient to use a rigid sheath previously shaped along the required path. FIGS. 10 and 11 show the rear face of facing elements 4 thus produced, capable of receiving two reinforcement strips at levels vertically spaced apart. The sheaths 40 define the paths within the element 4 between the emergence points 6. They may be preformed rigid sheaths, for example according to one of the shapes illustrated by FIGS. 5 to 9.

In the example shown in FIG. 10, the slots corresponding to the emergence points PE1, PE2 for the same strip are situated in distinct vertical planes, so that a space, for example of between 2 and 5 cm, separates the vertical planes PV1 and PV2 separating the closest emergence points of the same strip. The physical separator 41, in continuity of material, affords the offset between the two emergence planes.

In the example shown in FIG. 11, the two slots corresponding to the emergence points PE1, PE2 are situated between two same vertical planes and cross a common vertical plane PV3. The physical separator 42, in continuity of material, provides the offset between the two emergence planes.

An embodiment according to FIGS. 10 and 11 requires an operation of fitting the strips along their paths. However, it provides the advantage of offering the possibility of choosing the length of strip independently of the manufacture of the facing element.

In general terms, the proposed connection method, between the facing of a stabilized soil structure and at least some of the reinforcement strips thereof, is compatible with a large number of structure configurations, strip lengths, strip fitting densities, etc.

The invention claimed is:

1. A stabilized soil structure comprising:

a fill;

reinforcement strips extending in a reinforced area of the fill situated to the rear of a front face of the structure; and a facing placed along said front face, the reinforcement strips being anchored to the facing in respective anchoring regions, wherein the facing incorporates, in at least one anchoring region, a path formed for a reinforcement strip between two emergence points situated on a rear face of the facing adjacent to the fill, wherein the path comprises two adjacent portions respectively adjacent to the two emergence points and each disposed so as to position strip in a respective emergence plane substantially perpendicular to said rear face, two curved portions provided as respective extensions of the two adjacent portions and disposed so as to deviate the strip out of the emergence planes, and a connecting portion connecting together the two curved portions, wherein the two emergence planes are distinct, separated by a physical separator and substantially parallel to each other in order to form top and bottom emergence planes, said physical separator being in continuity of material in the anchoring region of the facing, or made of a piece attached in the anchoring region of the facing, and wherein the connecting portion comprises at least one loop situated outside the emergence planes and outside the space between said emergence planes.

2. The structure of claim 1, wherein the two substantially parallel emergence planes are separated in the anchoring region by a distance greater than or equal to 2 cm and less than or equal 20 cm.

3. The structure of claim 2, wherein the two substantially parallel emergence planes are separated in the anchoring region by a distance greater than or equal to 5 cm and/or less than or equal to 15 cm.

4. The structure of claim 1, wherein the adjacent portions emerge on the rear face of the facing in the form of slots, comprising the emergence point, and wherein two slots connected by the same path are offset so as not to cross a common vertical plane.

5. The structure of claim 1, wherein the adjacent portions emerge on the rear face of the facing in the form of slots, comprising the emergence point, and wherein two slots connected by the same path cross a common vertical plane.

6. The structure of claim 1, wherein the facing is produced from panel-shaped elements, and wherein the adjacent portions of said path are rectilinear and extend in their respective emergence planes over at least half of the thickness of a panel-shaped facing element.

7. The structure of claim 1, wherein the facing has, in the anchoring region, a protective sheath receiving the reinforcement strip along said path.

8. A facing element for a stabilized soil structure comprising a body made from cast material having a path formed therein for receiving a reinforcement strip between two emergence points situated on a rear face of the body, wherein the path comprises two adjacent portions respectively adjacent to the two emergence points and each disposed so as to position the strip in a respective emergence plane perpendicular to said rear face, two curved portions provided as respective extensions of the two adjacent portions and disposed so as to deviate the strip out of the emergence planes, and a connecting portion connecting together the two curved portions, wherein the two emergence planes are distinct, separated by a physical separator and substantially parallel to each other, said physical separator being in continuity of material in the anchoring region of the facing, or made of a piece attached in the anchoring region of the facing, and wherein the connecting portion comprises at least one loop situated outside the emergence planes and outside the space between said emergence planes.

9. The facing element of claim 8, wherein the two substantially parallel emergence planes are separated in the anchoring region by a distance greater than or equal to 2 cm and less than or equal to 20 cm.

10. The facing element of claim 9, wherein the two substantially parallel emergence planes are separated in the anchoring region by a distance greater than or equal to 5 cm and/or less than or equal to 15 cm.

11. The facing element of claim 8, wherein the adjacent portions emerge on the rear face of the facing in the form of slots, comprising the emergence point, and wherein two slots connected by the same path are offset so as not to cross a common vertical plane when said facing element is disposed in a position similar to the one that it would occupy in an erected structure.

12. The facing element of claim 8, wherein the adjacent portions emerge on the rear face of the facing in the form of slots, comprising the emergence point, and wherein two slots connected by the same path cross a common vertical plane when said facing element is disposed in a position similar to the one that it would occupy in an erected structure.

13. The facing element of claim 8, wherein the body has a panel shape, and wherein the adjacent portions over said path are rectilinear and extend in their respective emergence planes over at least half of a thickness of the body measured perpendicular to the rear face.

14. The facing element of claim 8, further comprising a protective sheath surrounded by the molded material of the body, in order to receive the reinforcement strip along said path while isolating the strip from the molded material.

15. The facing element of claim 14, wherein the strip is not installed in the sheath when the element is produced.

16. The facing element of claim 8, wherein the strip is positioned on said path as soon as the material of the body is molded.

17. A method of constructing a stabilized soil structure, comprising:

disposing at least one facing element along a front face of the structure delimiting a volume to be filled, wherein the facing element comprises a body made from cast material having a path formed therein for receiving a reinforcement strip between two emergence points situated on a rear face of the body, wherein the path comprises two adjacent portions respectively adjacent to the two emergence points and each disposed so as to position the strip in a respective emergence plane perpendicular to said rear face, two curved portions provided as respective extensions of the two adjacent portions and disposed so as to deviate the strip out of the emergence planes, and a connecting portion connecting together the two curved portions, wherein the two emergence planes are distinct, separated by a physical separator, said physical separator being in continuity of material in the anchoring region of the facing, or made of a piece attached in the anchoring region of the facing, and substantially parallel to each other, and wherein the connecting portion comprises at least one loop situated outside the emergence planes and outside the space between said emergence planes;

bringing and compacting filling material substantially horizontally in said volume up to a bottom emergence plane of said facing element so as to create a laying surface;

arranging a reinforcement strip that follows said path in the facing element so that two reinforcement strip portions emerge from the rear face of the facing element and rest on the laying surface; and tensioning the strip by adding filling material on the strip.

* * * * *